US005709155A

United States Patent [19]

Terracciano

[11] Patent Number: 5,709,155

[45] Date of Patent: Jan. 20, 1998

[54] FOLDING TRAY TABLE FOR CHAIRS

[75] Inventor: James M. Terracciano, Commack, N.Y.

[73] Assignee: MUL Acquisition Corp. II, Wilmington, Del.

[21] Appl. No.: 372,170

[22] Filed: Jan. 12, 1995

[51] Int. Cl.[6] ..... A47B 23/00

[52] U.S. Cl. ..... 108/42; 108/152; 108/77; 297/145

[58] Field of Search ..... 108/75, 42, 44, 108/47, 69, 73, 65, 77, 152; 297/162, 173, 145; 248/240, 292.14; 16/319, 348, 343, 357, 360, 361, 363, 374, 380, 392

[56] References Cited

U.S. PATENT DOCUMENTS

| | | | |
|---|---|---|---|
| 131,456 | 9/1872 | Murphy . | |
| 141,985 | 8/1873 | Bennor | 108/69 |
| 1,892,687 | 1/1933 | Teufel | 248/292.14 X |
| 1,963,721 | 6/1934 | Smith | 248/292.14 X |
| 1,999,705 | 4/1935 | Sintz . | |
| 2,712,484 | 7/1955 | Adolphson . | |
| 2,815,529 | 12/1957 | Herbolsheimer et al. . | |
| 3,113,531 | 12/1963 | Barnard | 248/240 X |
| 3,215,467 | 11/1965 | McFarland et al. | 248/240 X |
| 3,583,760 | 6/1971 | McGregor | 297/145 |
| 4,673,148 | 6/1987 | Oliver | 248/292.14 |
| 4,750,432 | 6/1988 | McNamara . | |
| 5,022,617 | 6/1991 | Henderson | 248/292.14 X |

FOREIGN PATENT DOCUMENTS

| | | | |
|---|---|---|---|
| 281170 | 12/1927 | United Kingdom | 248/240 |

*Primary Examiner*—Jose V. Chen

*Attorney, Agent, or Firm*—Arthur A. Gardner & Associates

[57] ABSTRACT

A tray table assembly which can be positioned horizontally for use by a person in a chair. When not in use, the tray table can be folded against the side of the chair. A mount bracket is attached to the arm of the chair. Pin tracks are disposed in the mount bracket. A hinge bracket is attached to a tray table. Pin holes are disposed in the hinge bracket. The hinge bracket is pivotally engaged to the mount bracket by a clevis pin that extends through the pin holes and the pin tracks. The tray table can be moved from a first position where the tray table is maintained in a horizontal position, to a second position in which the tray table is free to rotate to the side of the chair. In the horizontal position, tabs on the hinge bracket engage slots in the mount bracket, thereby retaining the tray table in the horizontal position.

17 Claims, 2 Drawing Sheets

FOLDING TRAY TABLE FOR CHAIRS

FIELD OF THE INVENTION

The present invention relates to the field of seating products, particularly, to a tray table capable of folding conveniently against the side of a chair.

BACKGROUND OF THE INVENTION

Patients, such as the elderly or infirm, are often required to spend long periods of time in a chair, such as a reclining chair or a wheelchair. Because these patients are less mobile, it may be difficult for them to move to a standard chair at a table. Further, they may not be able to sit easily in a standard chair for any period of time. Consequently, such patients often must perform tasks, such as eating or reading a book, in their lap.

Tray tables have been developed that completely detach from invalid chairs. While these tables are useful, it is inconvenient to have a separate table which must be carried around with the chair. Further, because these tables are generally large and heavy, a care giver must mount and detach the table for the patient.

Tray tables that can be mounted to a chair are well known in the prior art. These tray tables fold out of the patient's way, to the side of the chair, when not in use. While these tray tables are convenient, they can be costly. In particular, they are generally made of many parts which are expensive to manufacture and assemble.

Many mechanisms for mounting drop leaves to tables are well-known. In U.S. Pat. No. 131,456, a table-leaf connection is disclosed in which plate-metal arms are mounted to the drop leaf. Slots are disposed in the arms. A pivot pin is mounted in the slots, thereby attaching the drop leaf to flanges mounted to the table. Locking hooks at the bottom of the flanges engage the arms and auxiliary locking hooks engage projections on the drop leaf when the drop leaf is in the horizontal position. A spring engages the pivot pin, resisting its displacement in the slot.

SUMMARY OF THE INVENTION

It is therefore an object to the present invention to provide a tray table for a chair which can be conveniently folded against the side of the chair.

It is also an object of the present invention to provide a folding tray table that can be inexpensively manufactured.

It is also an object of the present invention to provide a tray table which can be set up and folded away by the patient in the chair.

It is also an object of the present invention to provide a method of assembling a folding tray table assembly and mounting the assembly to a chair.

These and other objects of the present invention will be clear from the following description of the invention.

One aspect of the present invention relates to a tray table assembly for mounting a folding tray table to a chair. A hinge bracket, having at least one flange connected to a base, is mounted to the tray table. A pin hole is disposed in the flange. A mount bracket, having at least one side panel connected to a base, is mounted to the arm of the chair. A pin track is disposed in the side panel. A clevis pin extends through the pin hole and the pin track, thereby mounting the hinge bracket to the mount bracket.

Another aspect of the present invention relates to a method of assembling a tray table assembly capable of mounting a tray table to a chair. A hinge bracket is mounted to the tray table. A mount bracket is mounted to a chair. A clevis pin is inserted through a pin hole in the hinge bracket and through a pin track in the mount bracket. The tray table is thereby rotatably mounted to the chair such that it can be maintained in a horizontal position by the base and stored at the side of the chair when not in use.

DETAILED DESCRIPTION

Figure 1:
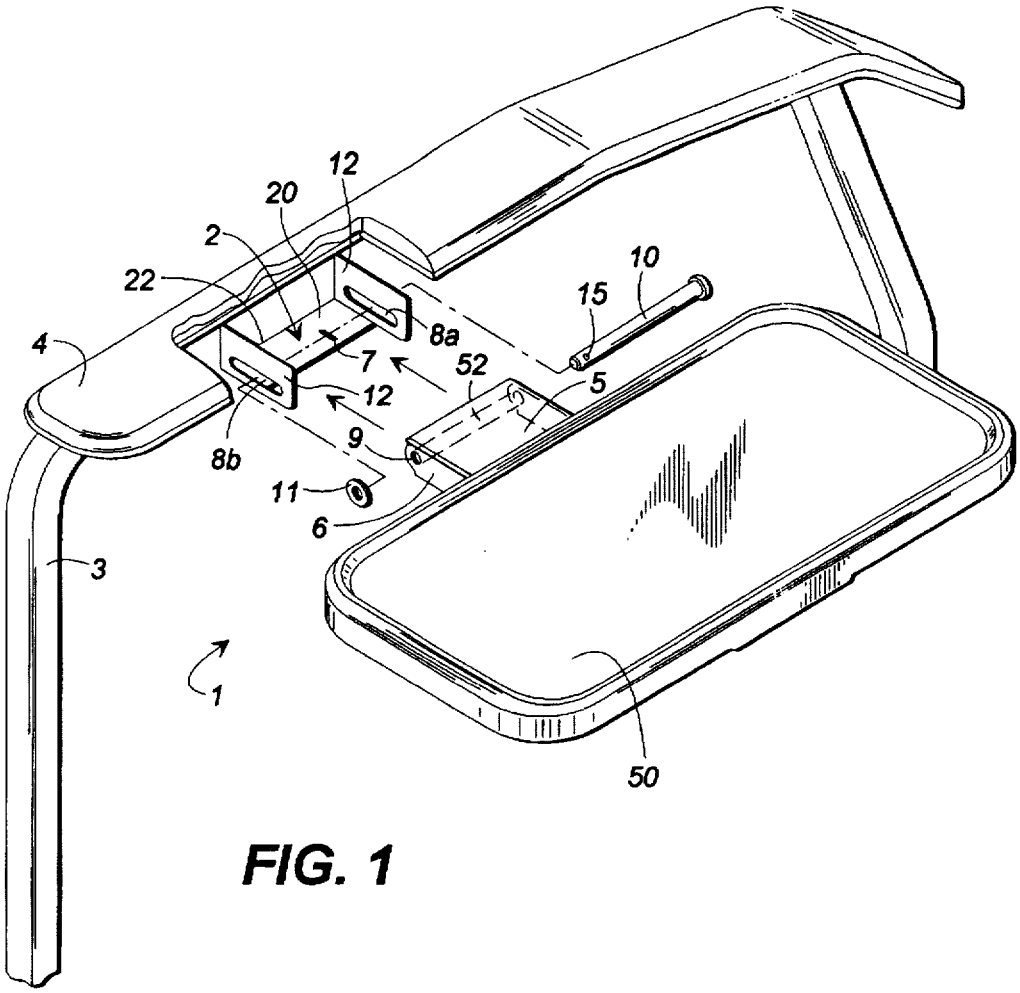
FIG. 1 us an exploded view of the tray table assembly of the present invention shown mounted to the arm of a chair.

FIG. 1 is an exploded view of a tray table assembly 1 of an embodiment of the present invention attached to the arm 3 of a chair, such as a recliner or a wheelchair. A mount bracket 2 is located at the outside of the arm (i.e., opposite the patient) and under an arm cushion 4. The mount bracket could be located at other positions on the chair and still practice the invention. The mount bracket comprises two side panels 12 connected by a base 20. Two slots 7 (only one shown in FIG. 1) are disposed in the base. Pin tracks **8*a*, 8*b*** are disposed in the side panels.

Figure 2:
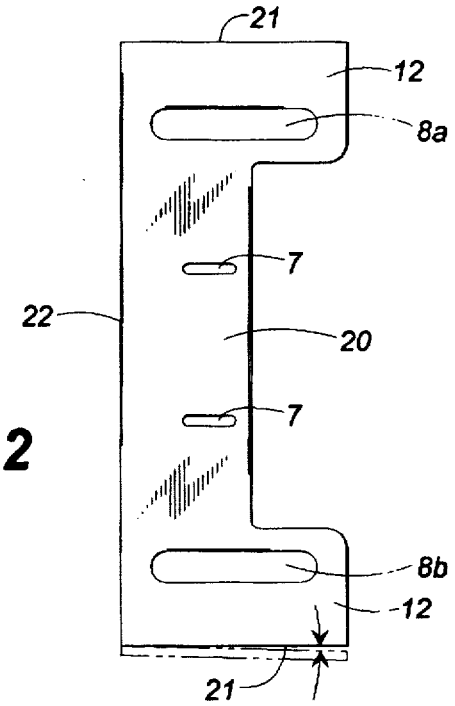
FIG. 2 as a top view of the mount bracket of the assembly of FIG. 1 shown in isolation before the side panels are folded with respect to the base.

FIG. 2 is a top view of the mount bracket 2 shown in isolation. The side panels 12 are formed integrally with the base 20. The mount bracket is preferably formed from a flat piece of malleable material, such as aluminum or other metals. The side panels are then bent up, perpendicular to the base, to prepare the mount bracket for use with the invention (see FIG. 1). The edges 21 of the side panels can be slanted inward slightly from perpendicular to the end 22 (such as at 1°) so that the edges are slanted with respect to the base after folding. When mounted to the arm 3, this slant causes the base to tilt slightly upward from horizontal. Further, the pin tracks **8*a*, 8*b*** also slant slightly upward. As discussed below, this makes the tray table assembly more stable in the horizontal position.

As shown in FIG. 1, the end 22 of the mount bracket is disposed adjacent to the arm 3. The side panels 12 extend further from the end 22 than the base 20 (see also FIG. 2). The pin tracks **8*a*, 8*b*** are disposed in the side panels such that at least one end of the tracks extend beyond the base.

Referring again to FIG. 1, a block 5 is mounted to a tray table 50 at the periphery of the table. Preferably, the block and tray table are blow molded in a single piece. The block is sized to fit between the side panels 12 of the mount bracket 2. A hinge bracket 6 (see FIGS. 3 and 4) is attached at the underside of the block. Of course, the hinge bracket could be directly attached to the tray table. Two pin holes 9 (only one shown in FIG. 1) are disposed in the sides of the hinge bracket at the end near the arm. A bore 52 (shown in phantom) is disposed in the block between and aligned with the pin holes.

Figure 3:
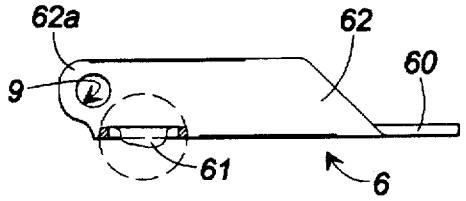
FIG. 3 is a side elevational view, partly in section, of the hinge bracket of the assembly of FIG. 1 shown in isolation.

FIG. 3 is a side elevational view, partly in section, of the hinge bracket 6 shown in isolation. Hinge flanges 62 are mounted to hinge pad 60 and extend up from the hinge pad, preferably at 90°. Preferably, a portion 62A of the hinge flange extends beyond the pad toward the arm 3 and the pin holes 9 are mounted, at least in part, in that portion. Tabs 61, shown in section, are mounted to the hinge pad and extend down from the hinge pad preferably at 90°. The tabs are mounted on the pad at the end near the pin holes. As currently preferred, the tabs are mounted to the hinge bracket and the slots are disposed in the mount bracket. Of course, the slots could be disposed in the hinge bracket and the tabs mounted to the mount bracket and still practice the invention.

Figure 4:
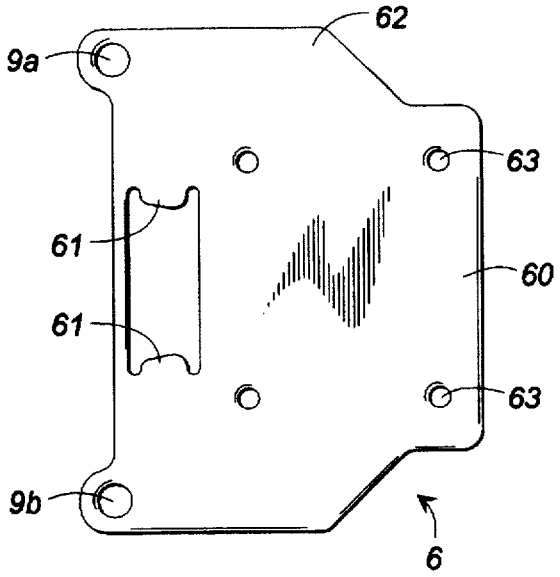
FIG. 4 is a top view of the hinge bracket of FIG. 3 shown in isolation before the flanges or tabs are folded with respect to the hinge pad.

FIG. 4 is a top view of the hinge bracket 6 shown in isolation. The hinge flanges 62 are integrally formed with the hinge pad 60 by a single piece of malleable material, such as aluminum or other metal. The hinge flanges are bent up, perpendicular to the hinge pad, for use with the invention (see FIG. 3). Tabs 61 are formed by punching a hole in the pad and then folding the tabs down, perpendicular to the pad. Bolt holes 63 are positioned in the pad to permit bolting of the hinge bracket to the block 6. Pin holes 9*a*, 9*b* are disposed in the flanges at one end.

Figure 5:
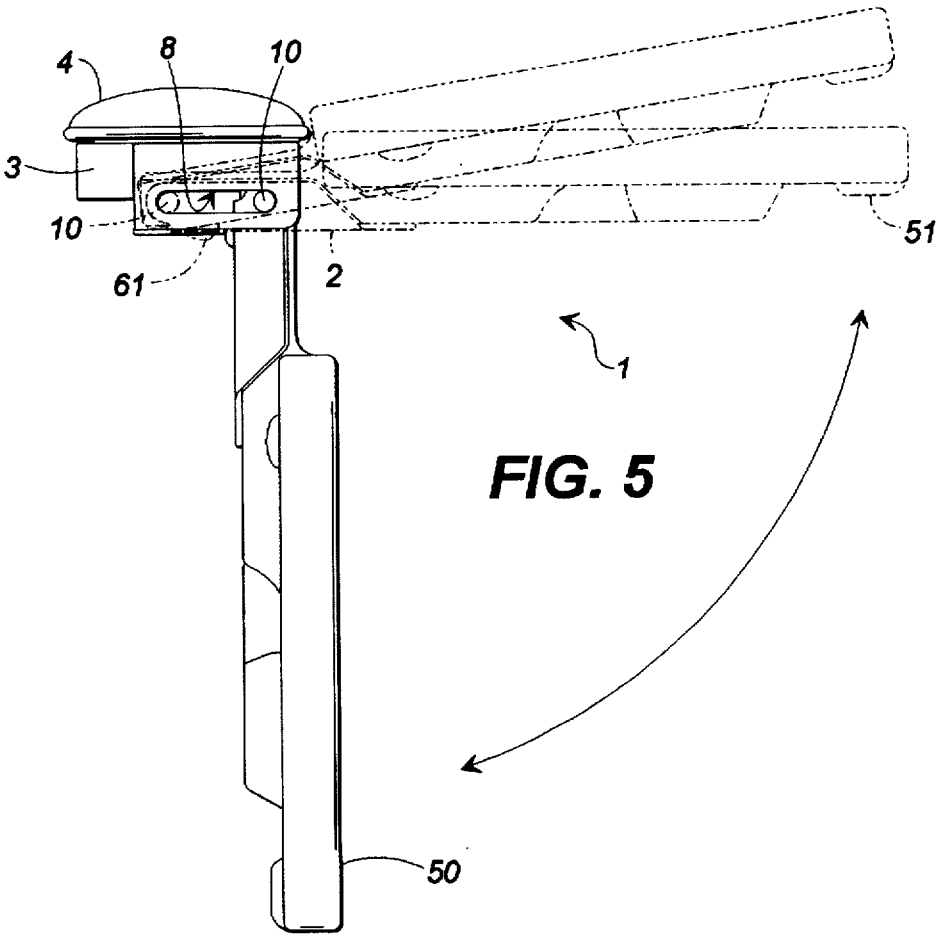
FIG. 5 is a front elevational view of the tray table assembly of FIG. 1 shown mounted to the arm of a chair in a vertical position, in a horizontal position and in an elevated position.

To attach the tray table 50 onto the chair, the mount bracket 2 is mounted to the arm of the chair, such as by welding or other such means. The hinge bracket 6 is mounted to the block 5, such as by bolting or other such means. The block and hinge bracket are inserted between the side panels 12 of the mount bracket. A clevis pin 10, shown in FIGS. 1 and 5, is inserted through one pin track 8*a* on the mount bracket, through one pin hole 9*a* on the hinge bracket, through the bore 52 in the block, through the other pin hole 9*b* and through the other pin track 8*b*. A ball detent 15 mounted on one end of the clevis pin thus protrudes from the side panel of the mount bracket. A washer 11 is slipped over the ball detent, thereby preventing the clevis pin from slipping back through the track. The clevis pin permits the table to rotate from a horizontal position to a vertical position adjacent the side of the chair. Further, the clevis pin can slide along the pin track, moving the tray table closer to or further from the recliner, as will be discussed further below. Alternatively, hubs could be mounted on the hinge bracket at the location of the pin holes. The hubs could directly engage the pin tracks.

FIG. 5 is a front elevational view of the tray table assembly 1 of the present invention mounted to the arm 3 of the chair in a horizontal position for use, in a vertical position for storage and in an elevated position (shown in phantom). To lock the tray table 50 for use in the horizontal position, the tray table is rotated about the clevis pin 10 to the horizontal position, and moved toward the arm of the chair. The block 5 and hinge bracket 6 slide over the base 20 of the mount bracket 2 and are disposed between the arm cushion 4 and the mount bracket. The tabs 61 on the hinge bracket engage the slots 7 of the mounting bracket. The block and the hinge bracket (and thus the table) are prevented from rotating by base of the mount bracket. Further, the block is prevented from sliding out from over the mount bracket due to the engagement of the tabs to the slots. The slight upward slant of the pin tracks 8 and the base further stabilize the tray table in the horizontal position.

To release the tray table 50, the edge of the table is lifted, rotating the tray table to an elevated position (shown in phantom in FIG. 5). The tabs 61 are thus disengaged from the slots 7. A lip 51 may be disposed at the underside of the tray table to permit easier gripping. The tray table can then be moved freely away from the arm 3 as the clevis pin 10 slides in the pin track 8. When the block 5 and hinge bracket 6 are moved away from the mount bracket such that they are no longer disposed above the base 20, the tray table is free to rotate about the clevis pin. Consequently, the tray table can be rotated against the side of the chair when not in use.

The foregoing description of a preferred embodiment is not intended to limit the scope of the invention which is defined by the following claims:

I claim:

1. A folding tray table assembly for mounting to an arm of a chair comprising:

a mount bracket adapted to be mounted to the arm of the chair, said mount bracket having a base and at least one side panel extending from said base, said mount bracket further having a pin track disposed in said side panel and extending substantially horizontally;

a tray table;

a hinge bracket having a hinge pad and at least one flange extending from said hinge pad, wherein said hinge bracket is mounted to said tray table, and wherein at least one pin hole is disposed in said flange; and a clevis pin disposed in said pin track and said pin hole, wherein said clevis pin, said hinge bracket, and said mount bracket cooperate to allow said tray table to be shifted between a first position in which said tray table is supported by said base in a substantially horizontal orientation with said hinge bracket resting on said base and a second position in which said tray table is suspended from said mount bracket.

2. The assembly of claim 1 wherein said side panel is integral with said base of said mount bracket.

3. The assembly of claim 1 further comprising a tab mounted to said hinge bracket and adapted for engagement in a slot disposed in said mount bracket.

4. The assembly of claim 3 wherein said tab is integral with said hinge pad.

5. The assembly of claim 1 further comprising a block mounted at a periphery of said tray table and wherein said hinge bracket is mounted to said block.

6. A tray table assembly for mounting to an arm of a chair comprising:

a hinge bracket comprising flanges connected by a hinge pad, wherein pin holes are disposed in said flanges;

a tray table mounted to said hinge bracket such that at least a portion of said flanges, including at least a portion of said pin holes, extends beyond a periphery of said tray table;

a mount bracket adapted to be fixedly mounted to the arm of the chair, said mount bracket having two side panels connected by a base, wherein pin tracks are disposed in said side panels;

a clevis pin extending through said pin holes and said pin tracks thereby pivotally mounting said hinge bracket to said mount bracket;

wherein said tray table is displaceable from a first position in which said hinge bracket is prevented from pivoting in one direction by said base to a second position in which said hinge bracket is capable of pivoting about said clevis pin.

7. The assembly of claim 6 further comprising tabs attached to the hinge bracket and wherein slots are disposed in the mount bracket such that the tabs engage the slots when the tray table is in the first position.

8. The assembly of claim 6 wherein the table further comprises a block mounted at the periphery of the table and the hinge bracket is mounted to the block.

9. The assembly of claim 6 wherein bolt holes are disposed in the hinge pad.

10. The assembly of claim 6 further comprising a lip mounted to the tray table.

11. An apparatus for mounting a tray table to a chair and adapted for storing the tray table against a side of the chair, said apparatus comprising:

a hinge bracket having two hinge flanges connected by a hinge pad, wherein pin holes are disposed in said hinge flanges;

at least one tab mounted to said hinge pad;

a mount bracket comprising two side panels connected by a base, wherein pin tracks are disposed in said side panels and wherein at least one slot is disposed in said base;

pivot means for pivotally mounting said hinge bracket to said mount bracket, said pivot means being disposed in said pin tracks and said pin holes;

wherein said pivot means can be displaced from a first position in which said hinge bracket is free to pivot with respect to said mount bracket and a second position in which the hinge bracket is prevented from pivoting in one direction by said base and pivotal motion in an opposite direction is limited by the arm of the chair; and wherein said tab engages said slot when said pivot means is in said second position.

12. The apparatus of claim 11 wherein the side panels are integral with the base.

13. The apparatus of claim 11 wherein the flanges are integral with the pad.

14. The apparatus of claim 11 wherein the pin tracks are pitched slightly upward when the clevis pin is in the second position.

15. The apparatus of claim 11 wherein the pivot means comprises a clevis pin.

16. A folding tray table assembly for mounting to an arm of a chair comprising:

a mount bracket adapted to be mounted to the arm of the chair, said mount bracket having a base and at least one side panel extending from said base, said mount bracket further having a slot disposed therein and having a pin track disposed in said side panel;

a tray table;

a hinge bracket having a hinge pad and at least one flange extending from said hinge pad, wherein said hinge bracket is mounted to said tray table, and wherein at least one pin hole is disposed in said flange;

a clevis pin disposed in said pin track and said pin hole; and a tab mounted to said hinge bracket, said tab being adapted for engagement in said slot of said mount bracket.

17. The assembly of claim 16 wherein said tab is integral with said hinge pad.

* * * * *